US005480256A

United States Patent [19]

Itsekson et al.

[11] Patent Number: 5,480,256

[45] Date of Patent: Jan. 2, 1996

[54] METHOD AND APPARATUS FOR THE PREPARATION, PLACEMENT, AND COMPACTING OF COMPONENTS OF FIBROUS CONCRETE AND MIXTURES THEREOF

[76] Inventors: Boris Itsekson, 410-44th Ave., #105, San Francisco, Calif. 94121; Michael Dyuzhenko, 18 Olminskogo Street, #10, 310024 Kharkov, Ukraine; Vladimir Itsekson, 11 Stroiteley Street, #31, Moscow Region, 143952 Reutov, Russian Federation; Alexander Itsekson, 642 Alvarado St., #108, San Francisco, Calif. 94114; Igor Tsigelman, 223 - 25th Ave., #7, San Francisco, Calif. 94121

[21] Appl. No.: 299,491

[22] Filed: Aug. 31, 1994

[51] Int. Cl.[6] ..... E01C 19/00

[52] U.S. Cl. ..... 404/72; 404/81; 404/101; 404/102; 366/18; 366/19

[58] Field of Search ..... 404/72, 80, 81, 404/83, 100, 101, 102; 366/345, 346, 6, 8, 16, 18, 19, 21

[56] References Cited

U.S. PATENT DOCUMENTS 2,863,651 10/1957 McBride ..... 366/19

4,881,819 11/1989 Blees ..... 366/19

5,044,819 9/1991 Kilheffer et al. ..... 366/18

*Primary Examiner*—Ramon S. Britts

*Assistant Examiner*—Pamela A. O'Connor

[57] ABSTRACT

A method for the preparation, placement, and compacting of fibrous concrete material components laid onto an object which consists of forming on a conveyor a sandwich consisting of sequential layers of a mortar component, long fibers, coarse aggregate, directing the sandwich onto the surface of large-diameter rotor (113), converting the components of the sandwich into a controllable flow (F), directing a part of the components onto the object (O) and a part onto a second small-diameter rotor (115) having blades (115*a*) longer in the radial direction than blades (113*a*) of the rotor (113), and controlling the direction, speed, density distributions, and distribution of the flow components by adjusting the amount of short fibers added to the flow and by introducing into the flow a third rotor (116). The apparatus for the realization of the method contains a three-rotor-type dispenser with the third rotor (116) pivotal with around the center of rotation of the second rotor (115).

16 Claims, 8 Drawing Sheets

METHOD AND APPARATUS FOR THE PREPARATION, PLACEMENT, AND COMPACTING OF COMPONENTS OF FIBROUS CONCRETE AND MIXTURES THEREOF

BACKGROUND—FIELD OF INVENTION

The present invention relates to the field of construction, particularly to the preparation, placement, and compacting of fibrous concrete components and mixtures thereof with other components.

BACKGROUND—DESCRIPTION OF THE PRIOR ART

At the present time dispersely-reinforced fibrous concrete finds ever increasing use in the operations of the world's leading construction companies. Dispersely-reinforced fibrous concrete is a construction material comprising a concrete matrix with randomly dispersed metallic, glass, synthetic, mineral or similar fibers. The fibers are used for reinforcement.

In particular, the dispersely-reinforced fibrous concrete (hereinafter referred to as DRFC) find wide application in the construction of industrial, civil, reclamation, sewage, transportion projects and power-plants, especially in seismic regions.

This material possesses an improved tensile strength, resistance to bending, as well as cavitation-, corrosion-, temperature-, and frost-resistant properties.

Another advantage of the DRFC is that the structures built using this material are capable of withstanding significant deformations without deterioration. Furthermore, the DRFC is resistant to cracking even under ultimate stress conditions.

A rotary method and apparatus for the preparation, placement, and compacting of DRFC are known in the art (USSR Inventor's Certificate No. 1,838,550, issued 1993 to B. Itsekson et al.).

The aforementioned apparatus is shown schematically in FIG. 1. It consists of a portal frame 30 which can be installed on a moveable carriage 32. Carriage 32 has wheels 34 driven by an electric motor 36. Wheels 34 may roll along guide rails 38 (only one wheel 34 is designated in the drawings).

Portal frame 30 consists of vertical columns 40 and 42 (four such columns are available, although only two of them are designated in the drawings) which support an upper horizontal frame 44. Upper horizontal frame 44 has transverse guides 46 and 48 which are used for guiding rollers 50 and 52 (only two of which are shown although four are available) of a hopper 54 for coarse aggregate such as gravel or crushed rock. Transverse guides extends in the direction perpendicular to the direction of rails 38.

Attached to hopper 54 is a downwardly extending L-shaped arm 56 consisting of a vertical leg **56*a* attached to hopper 54 and a horizontal leg 56*b*. A feed conveyor 58 is attached to vertical leg 56*a* and is slightly inclined downward toward its unloading end 58*a*. Hopper 54 has an adjustable gate 54*a* which defines the cross-sectional area of a hopper outlet opening 54*b***.

Via a bracket 60 hopper 54 also supports a hopper 62 for a concrete mortar. Hopper 62 has its unloading opening 64 located directly over a funnel 66 for receiving the concrete mortar from hopper 62. Funnel 66 is rigidly connected to feed conveyor 58 at its unloading end **58*a***.

Hopper 62 supports two additional small hoppers 68 and 70. Hopper 68 contains a long fibrous material such as metallic, synthetic, glass or similar fibers which has a length-to-diameter ratio exceeding 100. It is located above conveyor 58. Hopper 70 contains short fibrous materials, such as metallic, synthetic, glass or similar fibers having a length-to-diameter ratio less than 100. Hopper 70 is located direct above funnel 66.

Horizontal leg **56*b* of L-shaped arm 56 supports at its free end a dispensing unit 72. Dispensing unit 72 is made in the form of a two-level four-rotor mechanism. The upper level is formed by small-diameter rotors 74*a* and 74*b* which are driven into rotation from a motor (not shown). The lower level is formed by two large-diameter rotors 76 and 78, each of which has an individual drive (not shown). Rotor 76 is attached to a lower end of an arm 80 the upper end of which is pivotally connected to the axis of rotor 74*a*. Rotor 78 is attached to a lower end of an arm 82 the upper end of which is pivotally connected to the axis of rotor 74*b*. Axes of rotors 76 and 78 are interconnected through an adjustable telescopic link 84. A control adjustable telescopic link 86 is pivotally connected between the axes of rotor 78 and horizontal leg 86. The length of link 86 can be adjusted manually, e.g., by a wrench (not shown). The distance between rotors 76 and 78 also can be adjusted via telescopic link 84. An outlet opening 66*a* of funnel 66 is located directly above the space between rotors 74*a*, 74*b***.

Small-diameter rotors **74*a* and 74*b* have radially outwardly extending elements such as radially-arranged blades 75*a* and 75*b***, respectively (although four such blades are on each rotor, only one of them is designated by a reference numeral). These blades are arranged along the entire length of the rotors and have a height of about 40 mm.

Large-diameter rotors 76 and 78 have radially-arranged blades **76*a* and 78*b***, respectively (although eight such blades are on each rotor, only one of them is designated by a reference numeral). These blades are arranged along the entire length of the rotors and have a height of about 8 mm.

The left pair of rotors, i.e., rotors **74*a* and 76, rotate in the clockwise direction, while the right pair of rotors, i.e., rotors 74*b* and 78**, rotate in a counterclockwise direction.

It is understood that hopper 54, conveyor 58, funnel 66, hopper 62, hopper 68, and hopper 70, as well as entire dispensing unit 72 are moved as an integral unit together with hopper 54, when the latter performs transverse movements along guides 46 and 48.

The apparatus of FIG. 1 operates as follows:

With the unit consisting of the hoppers, conveyor and dispensing unit installed in a required transverse position above an object O which is to be molded of fibrous concrete, portal frame 30 is moved along rails 38 in the longitudinal direction of object O. Object O may comprise a form.

Upon completion of the formation of one strip of the object to be formed, the aforementioned moveable unit is shifted in the transverse direction and the longitudinal movement is repeated.

During the operation, the coarse aggregate (not shown) is loaded from hopper 54 onto feed conveyor 58 and the thickness of its layer on the conveyor 58 is determined by the position of gate **54*a*. The layer of the coarse aggregate is then coated with a layer of long fibers (not shown) from hopper 68 which is constantly open. The sandwich of the aggregate with fibers is then unloaded into funnel 66. Thus the sandwich consists, in the direction outwardly from the surface o the conveyor, of a layer of mortar, a layer of long fibers, and a layer of coarse aggregate. At the same time, funnel 66 is constantly loaded with a concrete mortar from constantly open hopper 62 through its adjustable unloading opening and with a short fibers from periodically open hopper 70. As a result, funnel 66** is filled with chaotically arranged components, such as an aggregate, long fibers, mortar, and short fibers.

The flow of the aforementioned material is unloaded from funnel 66 into a space between rotors 74*a* and 74*b*. Under the effect of impact pulses imparted from high blades 75*a* and 75*b*, the material is converted into a flow of discrete particles which are moved with the speed of 15 to 35 m/sec. This flow of discrete particles leaves the space between rotors 74*a* and 74*b* in the form of a dihedral angle of scattering. For clarity, refer to FIG. 2. In this drawing, the dihedral angle of scattering $\alpha$ is formed between two tangents. One tangent is to rollers 74*a* and 76 and the other tangent is to rollers 74*b* and 78.

The flow of discrete particles is directed, laid onto the surface of an object O (FIG. 3), and is compacted on the surface of the object due to centrifugal forces developed by the particles and then leaves rotor blades 74 and 74*b*. If object O has a finite length, three conditions are required. If the operation is started, e.g., from the right edge of object O, as shown in FIG. 2, rotor 78 is shifted to its lowermost position by means of control telescopic link 86. In this condition, rotor 76 remains in its uppermost position (FIG. 2) where it does not interfere with the flow of particles being unloaded onto object O. The introduction of rotor 78 into the flow of the particles separates the discrete flow of the particles which flies with the speed of 15 to 35 m/sec and isolates only the mortar particles. This is because the mortar particles have dimensions smaller than the height of blades 78*a*, so that only these particles can be caught by blades 78*a* and accelerated by them, while coarser particles, i.e., the long fibers and aggregate are only deflected but without increasing in speed. This makes it possible to increase the mortar component in the concrete matrix in the right corner of object O. Otherwise, because of recoil of coarse aggregate particles from the surfaces of the hard form, this zone would be formed with defects and reduced strength. Furthermore, the long fibers contact the hard surface of the form, recoil out from the hard surface and thus impairs the compacting conditions for the fibrous concrete in the form.

As portal frame 30 moves away from the right edge of object O and is located in the intermediate portion of the object (FIG. 3), rotor 78 is returned to its initial uppermost position. As a result, the flow is not separated any more, but the coarse particles of the aggregate will plunge into the layer of the concrete mixture, and the long fibers also will penetrate the concrete matrix and are pressed down by the grains of the aggregate.

The conditions near the left end of object O are the same as near the right end of object O. In this case, however, the flow of particles is controlled by rotor 76 which is introduced into the left side of the flow.

The above-described apparatus possesses a number of disadvantages which are described below.

1) Since the four-rotor dispensing unit has two small-diameter rotors 74*a* and 74*b* located at the upper level, these rotors cannot, because of their small diameters, develop centrifugal forces sufficient to plunge the mortar component from a flow F of discrete particles, supplied from funnel 66, deep into a layer 88 (FIG. 2). In other words, upper-level rotors 74*a* and 74*b* cannot provide layer 88 laid onto object O with the density and strength required to keep the fibers in the matrix material, whereby the structure obtained by molding the dispersely-reinforced fibrous concrete does not possess sufficient resistance to cracking and increased ability to deform without collapse under ultimate stress conditions.

2) Furthermore, since a pair of large-diameter rotors 76 and 78 are located at the lower level, they can be introduced into the flow F of discrete particles only with insignificant angle of interference (10°–12°). Otherwise the particles could recoil upward and layer 88 will have low density and strength. Because of small angle of interference of large-diameter rotors 76 and 78 with flow F their flow-controlling function is limited.

3) Because of inability of controlling the process, any sequence of loading of components (mortar, fiber, aggregate, etc.) to the feed flow in the space between rollers 74*a* and 74*b* could not affect the results of operation of dispensing unit 72 and, hence, the properties of obtained dispersely-reinforced layer 88. In other words, with any method of organization of the components in the feed flow, the above apparatus could not produce a dispersely-reinforced construction which would possess an increased resistance to cracking, high impact strength, and increased ability to deform without collapse.

4) The known apparatus and method of feeding fibers to the working space of rotors of the dispenser do not allow to control orientation of fibers in DRFC with predetermined fiber content by mass in the direction of three orthogonal axes.

SUMMARY OF THE INVENTION

It is an object of the present invention to provide an apparatus for the preparation, placement, and compacting of fibrous concrete which possesses an increased resistance to cracking, high impact strength, and increased ability to deform without collapse. Another object of the invention is to provide the above apparatus capable of developing centrifugal forces sufficient to impart to the structure the above properties.

It is another object to provide an apparatus of the above type which has a number of flow-controlling functions. Further object is to provide the above apparatus which may favorably utilize the sequence of the supply of components into the feed flow in the space between rotors of the upper layer. Still further object is to provide a method for the preparation, placement, and compacting of fibrous concrete or its components which produces a dispersely-reinforced construction having an increased resistance to cracking, high impact strength, and increased ability to deform without collapse.

Still another object of the invention is to provide a method and apparatus which allow to control orientation of fibers in DRFC with predetermined content by mass in the direction of three orthogonal axes.

Other objects and advantages of the present invention will become apparent after the consideration of the ensuing detailed description with the accompanying drawings.

DETAILED DESCRIPTION OF THE INVENTION

Figure 4:
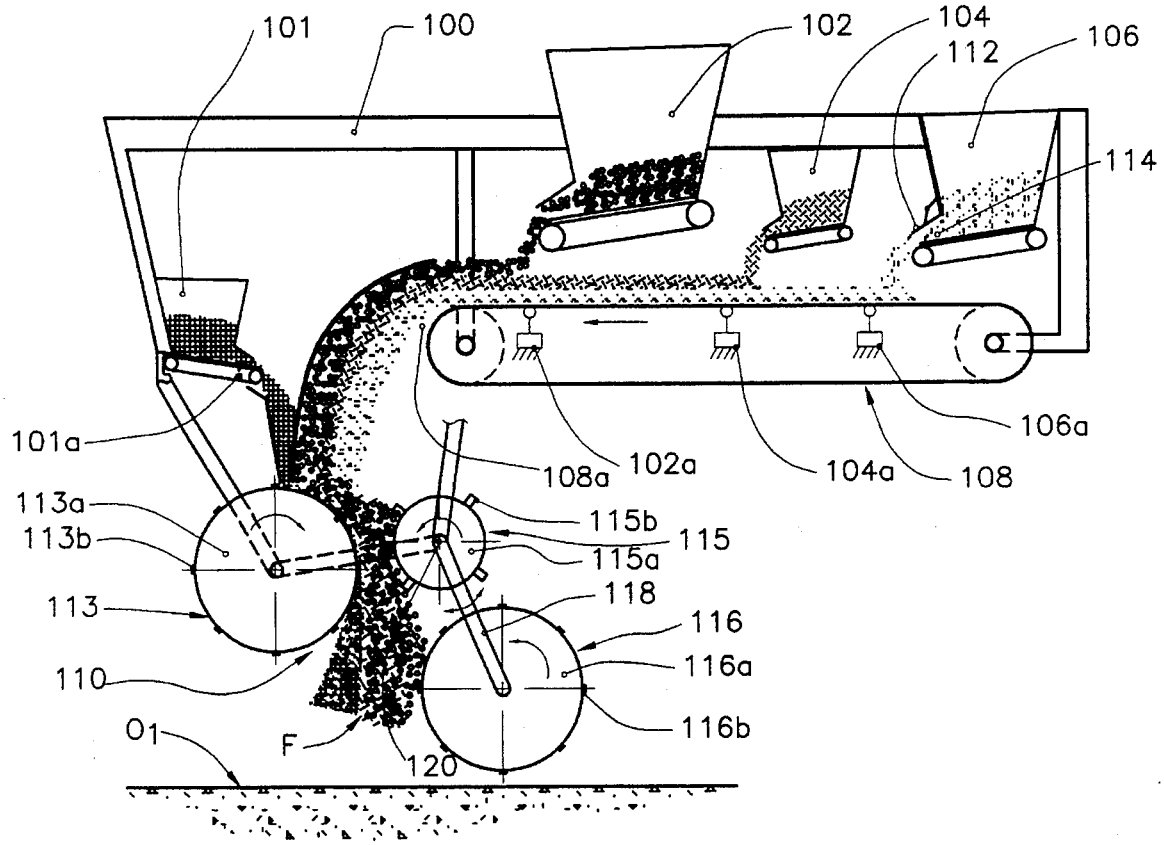
FIG. 4 is a schematic side view of the apparatus of the invention for the preparation, placement, and compacting of fibrous concrete mixture or its components.

A schematic side view of the apparatus of the invention for the preparation, placement, and compacting of fibrous concrete mixture or its components is shown in FIG. 4.

Figure 5:
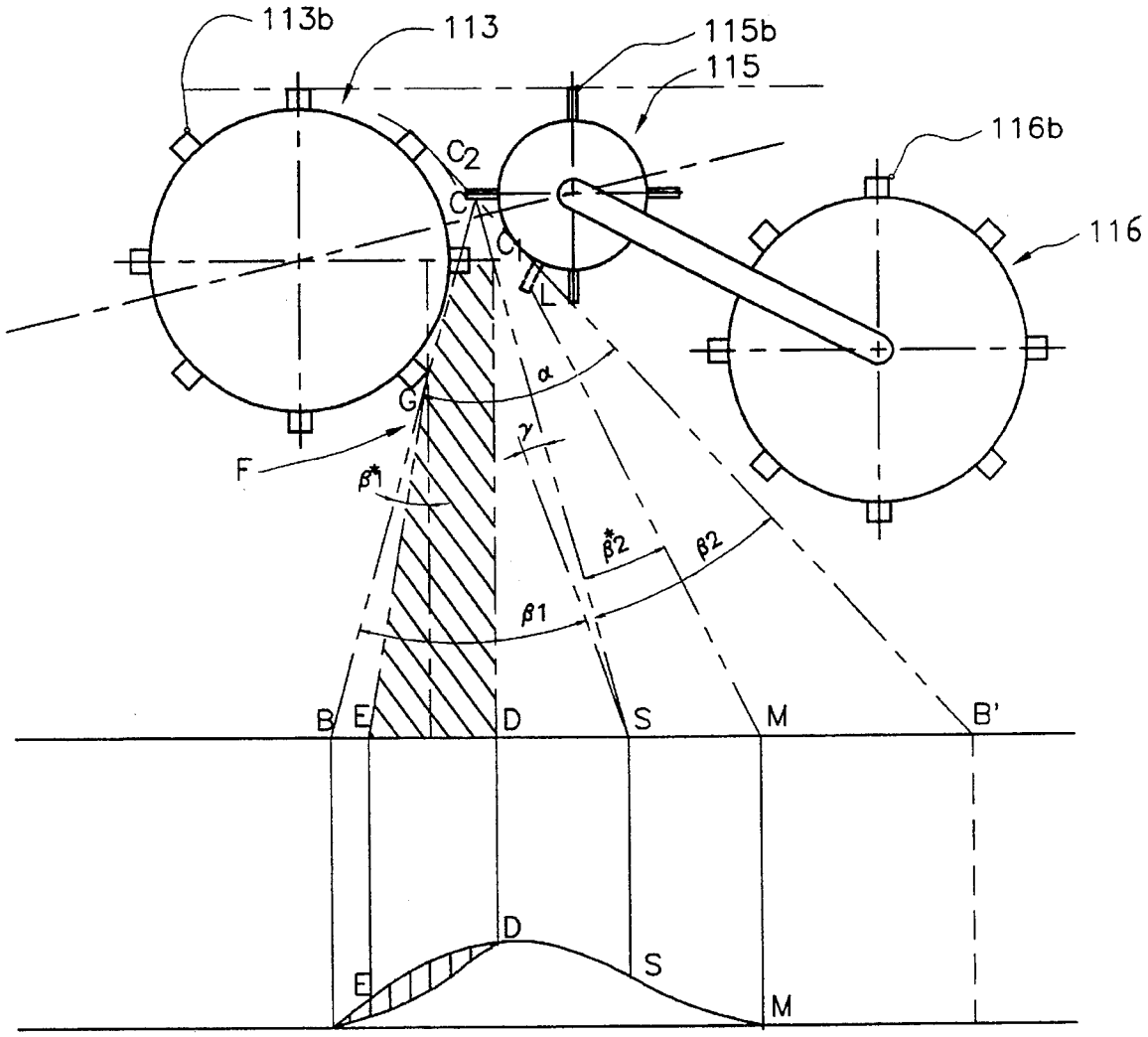
FIG. 5 is a schematic view illustrating the density distribution of of discrete particles of the flow in different sectors of the angle of scattering with the lower-level rotor moved away from the flow, the dispensing unit being stationary with respect to the object.

FIG. 5 is a schematic view illustrating the density distribution of discrete particles of the flow in different sectors of the angle of scattering. FIGS. 6 through 11 are schematic views of the dispensing unit of the apparatus of FIG. 4 illustrating various positions of a lower-level roller at different stages from the beginning to the end of the process.

As shown in the drawings, the apparatus consists of four main units, a rigid frame 100 which supports other units and may be attached, to the end of the crane boom (not shown) for manipulation of the device and positioning it over the object $O_1$.

A second unit is a set of loading hoppers 101, 102, 104, and 106 for loading various components of the mixture being prepared. These hoppers are arranged in series with hopper 101 containing short fibers, metal fibers, hopper 102 containing coarse aggregate, hopper 104 containing long fibers, metal fibers, and hopper 106 containing cement mortar.

A third unit is an essentially horizontal conveyor 108 above which all four hoppers 101 through 106 are installed.

A fourth unit is a mixture dispenser 110. All above units are attached to frame 100. Each of them will be described now in detail.

Hoppers 101, 102, 104, and 106 are generally identical to respective hoppers 70, 54, 68, and 62. Therefore their description is omitted. Furthermore, these hoppers are generally identical to each other and therefore an adjustable gate 112 and outlet opening 114 are designated only in hopper 106. Adjustable gate 112 and outlet opening 114 constitute means for dosed unloading of the hopper. Gate 112 and 114 and thus the doses of the material being unloaded are controlled by an operator or through a feedback (not shown).

Conveyor 108 is a conventional conveyor, e.g. a belt conveyor, having a width corresponding to the widths of outlet openings 114 of hoppers in the transverse direction. Each hopper 102,106, 104, and 101 may be equipped with a respective metering device 102*a*, 106*a*, 104*a*, and 101*a*, for controlling the weight of unloading components. The construction of such devices is known and is beyond the scope of the invention. Conveyor belt moves in the direction shown by arrow A, i.e., its unloading end 108A is located at the left end of the conveyor.

Dispenser 110 is located just under unloading end 108A of conveyor 108 and consists of three rotors, i.e., a larger-diameter rotor 113, a small-diameter rotor 115, and a large-diameter rotor 116. Each rotor consists of a cylindrical drum and radial blades. Thus, rotor 113 consists of a cylindrical drum 113*a* and blades 113*b*, rotor 115 consists of a cylindrical drum 115*a* and radial blades 115*b*, and rotor 116 consists of a cylindrical drum 116*a* and radial blades 116*b*. Rotors 113 and 115 are located at the upper level. Rotor 116 which is of the same diameter as rotor 113 is located at the lower level and is installed on the end of arm 118 which is pivotally supported on an axle 120 of rotor 115. In other words, rotor 116 can be pivoted around the axis of rotor 115 between a first extreme position where rotor 116 interferes with the flow of discrete particles and a second extreme position where it is beyond the boundaries of the flow.

An unloading end 117 of a conveyor 119 which is located directly under hopper 101 is located above large-diameter rotor 113, so that short fibers contained in hopper 101 could be directed along a guide trough 121 to the upper right-side surface of rotor 113 facing small-diameter rotor 115. Blades 113*b* and 116*b*, respectively, are of a relatively short radial length, while rotor 115 has blades 115*a* of a relatively long radial length. A ratio of the diameter of cylindrical drum 115*a* to the outer diameter of blades 115*b* is within the range of 0.4 to 0.7. A ratio of the diameter of cylindrical drum 113*a* to the outer diameter of its blades 113*b* is within the range of 0.93 to 0.98.

The diameter ratio of rotor drums of the upper level, i.e. of rotor drum 113*a* to rotor drum 115*a* is within the range of 1.04 to 1.82. The center distance between rotors 113 and 115 of the upper level may vary, depending on the composition of DRFC treated with the apparatus, but in any case the distance between the outer edges of oppositely arranged blades 113*b* and 115*b* should be within the range of 5 to 20 mm. Furthermore, the upper tips of blades 113*b* and 115*b* should be at the same vertical level. In addition, the plane passing through the centers of rotation of rotors 113 and 115 should form an angle of 5° to 25° to the horizontal plane.

The above ranges will now be substantiated.

If a ratio of the diameter of cylindrical drum 115*a* to the outer diameter of blades 115*b* is greater than 0.7, blades 115*b* are too high, which leads to substantial disintegration of the discrete flow and to an increase in the angle of scattering. As a result, the concrete will have a reduced density and strength.

If a ratio of the diameter of cylindrical drum 115*a* to the outer diameter of blades 115*b* is smaller than 0.4, the apparatus will be able to operate only on a fine-grade concrete and will be not be able to place and compact a coarse-grate concrete. Therefore, it is recommended that the above ratio should be within the range of 0.4 to 0.7.

If a ratio of the diameter of cylindrical drum 113*a* to the outer diameter of its blades 113*b* is less than 0.93, blades 113*b* will be too high and will disintegrate the coarse component of the cement, will change the composition of the mixture, and will not provide the optimum strength in the concrete.

If a ratio of the diameter of cylindrical drum 113*a* to the outer diameter of its blades 113*b* is greater than 0.98, blades 113*b* will be too short and will be incapable to capture the mortar component in a sufficient amount, which also will result in a decreased strength of the final product. Therefore, it is recommended that the above ratio be within the range of 0.93 to 0.98.

If the diameter ratio of rotor drum 113*a* to rotor drum 115*a* is less than 1.04, all advantages of the asymmetrical dispenser, which have been described above, will disappear, since both drums will be substantially of the same diameter. If, on the other hand, the above ratio exceeds 1.82, the angle of scattering will be too big, and it would be impossible to compact the concrete matrix to a required density. Therefore, the above ratio should be within the range of 1.04 to 1.82.

If the plane passing through the centers of rotation of rotors 113 and 115 is beyond the range of 5° to 25° to the horizontal plane, the apparatus will not satisfy the conditions described in the preceding paragraph.

The apparatus as a whole can be installed, e.g., on a telescopic boom of a crane for manipulation in the horizontal and vertical planes and for proper orientation of dispenser 110 with respect to the surface of object O. The vehicle which carries the apparatus is beyond the object of my invention, and therefore its description is omitted.

Operation of the apparatus of the Invention

Figure 1:
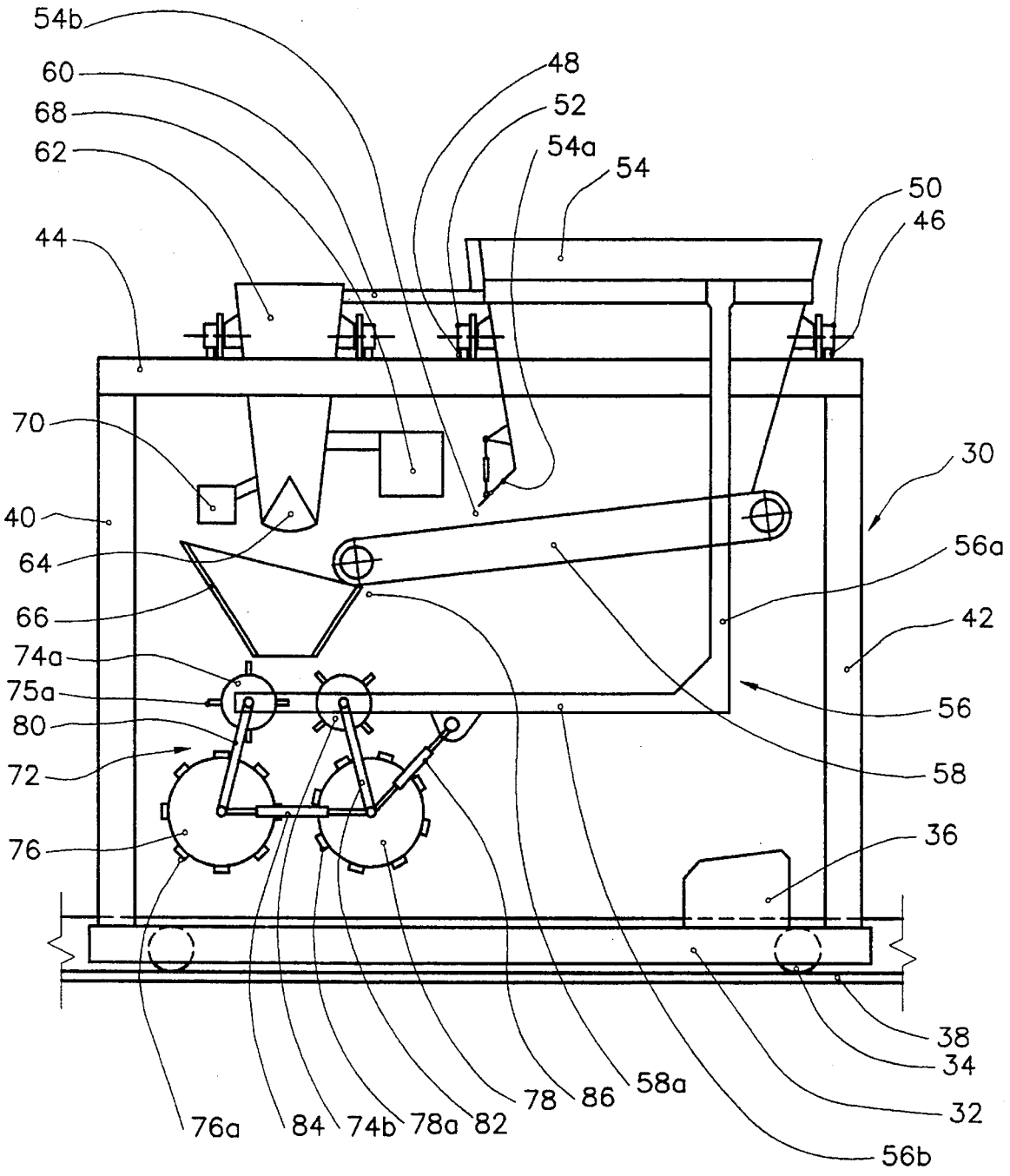
FIG.1 PRIOR ART
FIG. 1 is prior art which shows a schematic side view of a known apparatus for the preparation, placement, and compacting of fibrous concrete mixture or its components.
Figure 2:
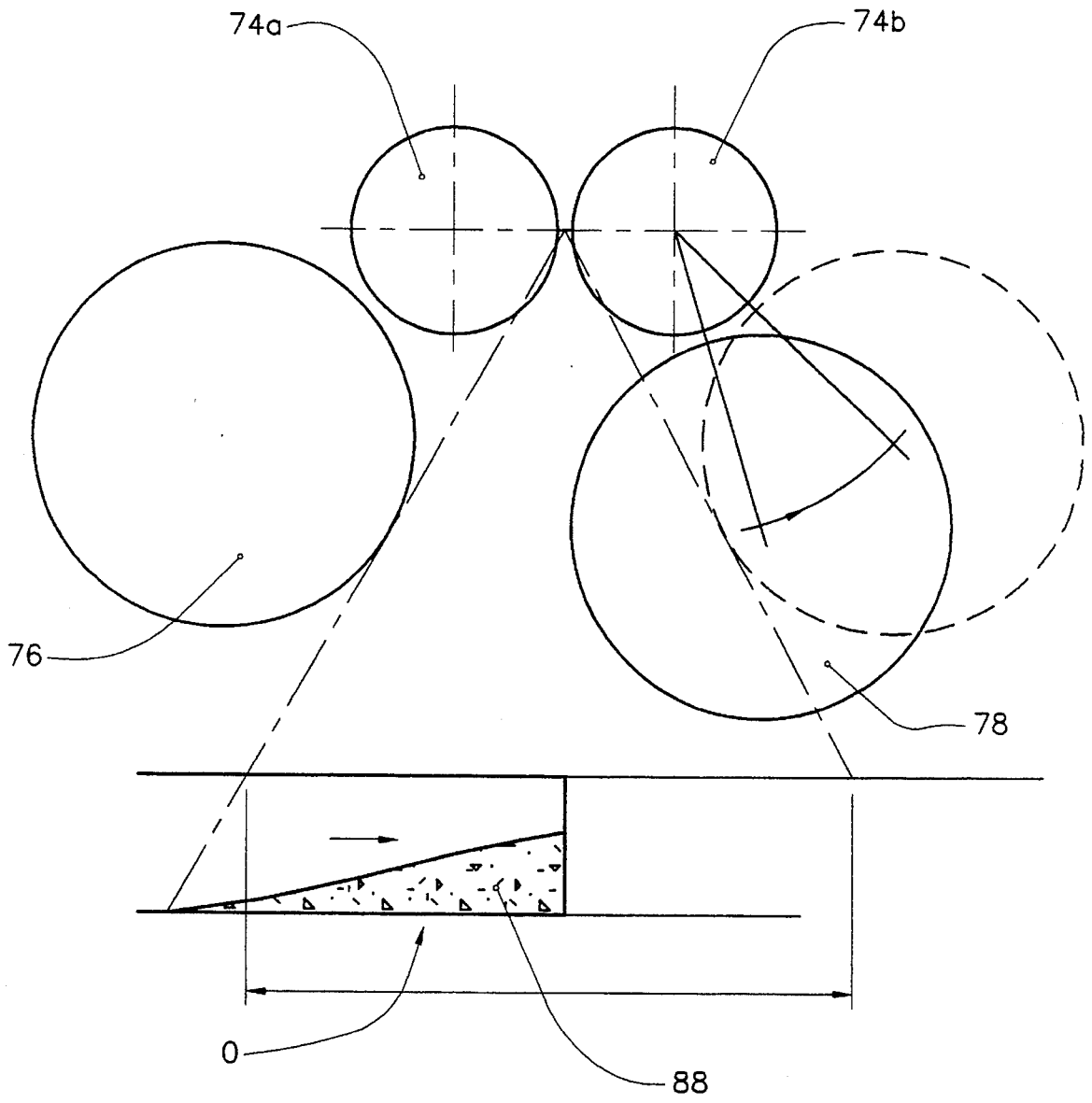
FIG.2 PRIOR ART
FIG. 2 is prior art which shows a schematic view illustrating the conditions at which in the apparatus of FIG. 1 the flow of discrete particles leaves the space between upper-level rotors in the form of a dihedral angle of scattering, the right-hand lower-level large-diameter rotor being introduced into the flow in the beginning of the process.
Figure 3:
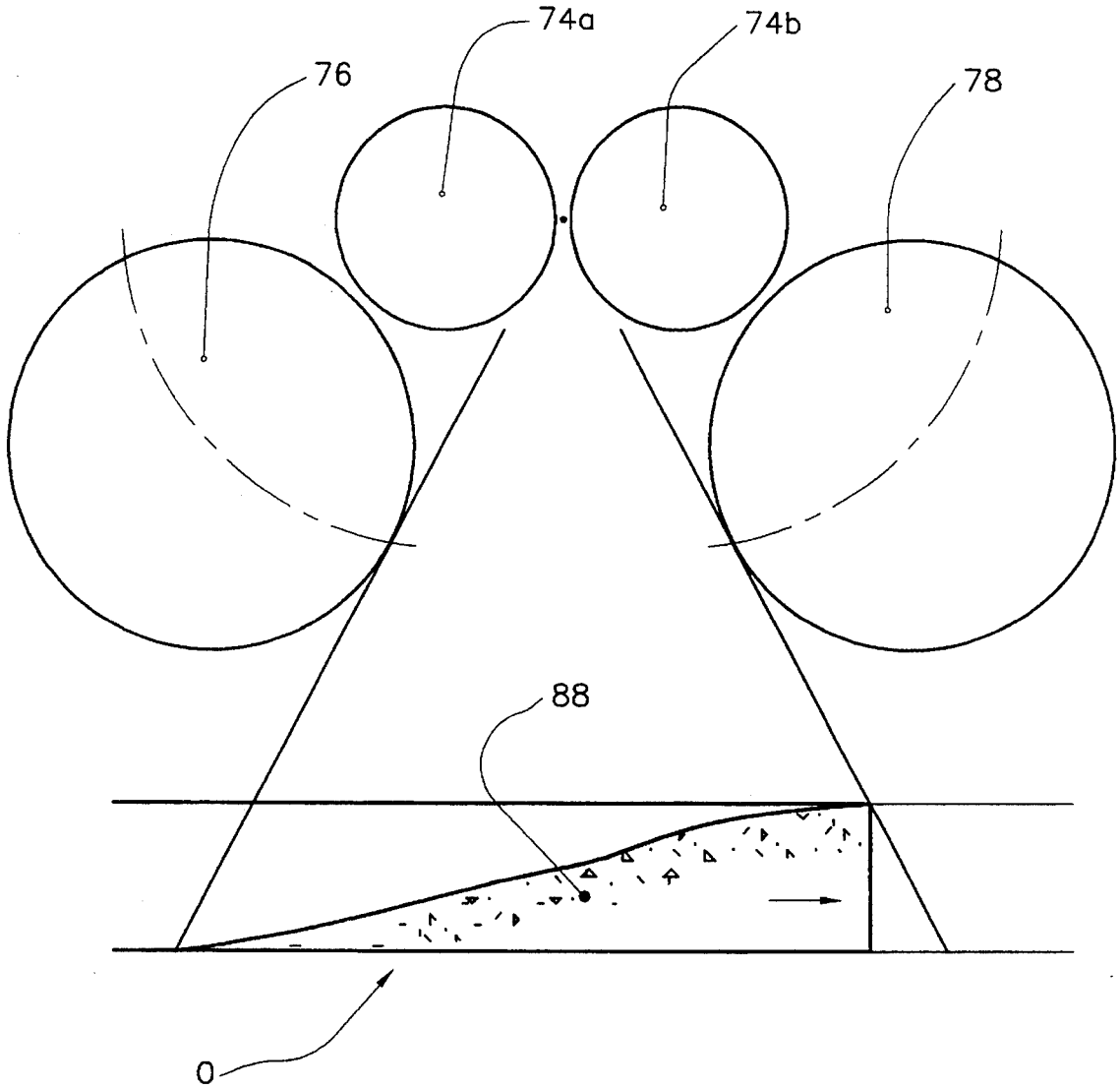
FIG.3 PRIOR ART
FIG. 3 is prior art which shows a view similar to FIG. 2 but with the lower-level large-diameter roller being removed from the flow in the intermediate part of the processes.

The apparatus of FIG. 1 operates as follows:

Prior to the use of the apparatus, its hoppers 101, 102, 104, and 106 are filled with respective components, i.e., hopper 101 is loaded with short fibers, e.g., metal fibers, hopper 102 with coarse aggregate, hopper 104 with long fibers, e.g., metal fibers, and hopper 106 with cement mortar.

The apparatus is then positioned, e.g., by means of a crane (not shown) above object O. Conveyor 108 and rotors of dispenser 110 are put into motion. Hoppers 106, 104, and 102 lay dosed amounts of respective materials onto conveyor 108, thus forming a "sandwich" consisting of a layer of cement mortar, a layer of long fibers, and a layer of coarse aggregate. In the course of movement of conveyor 108, the above multiple layer sandwich is unloaded in the form of a continuous flow F from unloading end 108*a* of the conveyer onto rotor 115 of dispenser 110.

Periodically, small dosed portions of short fibers are added to continuous flow F from hopper 101 by conveyor 117 through guide trough 121. These portions are directed onto the right upper side of roller 113 facing roller 115. Short fibers are first laid onto the surface of drum 113*a* between blades 113*b* in the area of the drum which is upstream with respect to the place of unloading of continuous flow F. Since in the course of rotation of rotor 113 short fibers that enter spaces between adjacent blades 113*b* are then coated by the heavy continuous flow F of other components of the concrete mixture, they do not recoil from the surface of rotor 113 (which is typical of the known apparatus) but remain in the flow.

Since large-diameter rotor 113 has short blades 113*b*, it can catch and supply into flow F (which is directed to the surface of object O) with its blade 113*b* only those particles and fibers the center of gravity of which is lower than the height of the blade. Other particles and fibers recoil from the surface of rotor 113 toward rotor 115, in particular, to the spaces between its long radial blades 115*b*. Normally, these are grains of the coarse aggregate and long fibers covered, in the process of transportation, with the cement mortar. As rotor 115 rotates, the above grains and fibers coated with the cement mortar slide over the surface of blades 115*b*. Since these blades have a high speed of rotation, the above components are thrown into flow F with high centrifugal forces and with high speed. Because the fibers and particles of coarse aggregate are thrown into the surface of object directionally with high force and high concentration, they are plunged deep into the well compacted matrix material and can be caught in this material without recoil. This is because, in distinction from the prior art apparatus which could lay the main mass of the mortar composition and short fibers with the speed of 40 m/sec, the apparatus of the invention may lay the main mass of the mortar component and short fibers with the speed of 90 m/sec.

Thus, it has been shown that, as a result of the process described above, the "sandwich" of components is converted into a flow F which is unloaded from dispenser 110 onto the surface of object O as a diverging flow with a predetermined angle of scattering α (FIG. 4). This diverging flow consists of two sectors which have different concentrations and speeds of discrete components of the flow.

In more detail the geometry of the outlet diverging flow F is shown in FIG. 5 which is a schematic view illustrating the distribution of concentrations of discrete particles of the flow in different sectors of the angle of scattering α with lower-level rotor 116 moved away from outgoing flow F, dispensing unit 110 being stationary with respect to the object. Blade 115*b* of rotor 115 starts scattering of particles in point C and leaves the zone of scattering in point L, thus forming a scattering sector with angle β2. The extreme points of this scattering sector on the surface of object O are points M and S. This sector, which will be further designated as sector MCS, is a zone where the long fibers and coarse aggregate have an increased concentration and are moved with a velocity of about 10–40 m/sec.

Blade 113*b* of rotor 113 starts scattering of particles in point C2 and leaves the zone of scattering in point G, thus forming a scattering sector with angle β1. The extreme points of this scattering sector on the surface of object O are points D and E. A front part of this sector which is limited by angle **β*1 is a zone where the short fibers and mortar component have an increased concentration and are moved with a velocity of about 25–90 m/sec. The front of this sector faces the direction of movement of dispenser 110** and is limited by side EG.

FIG. 5 shows in its lower part the profile of the layer of concrete formed on the surface of object O within sector MCE with dispenser 110 being stationary with respect to object O. The hatched zone in this profile corresponds to the area where the mortar component (together with short fibers, if there are any) has an increased concentration.

Figure 6:
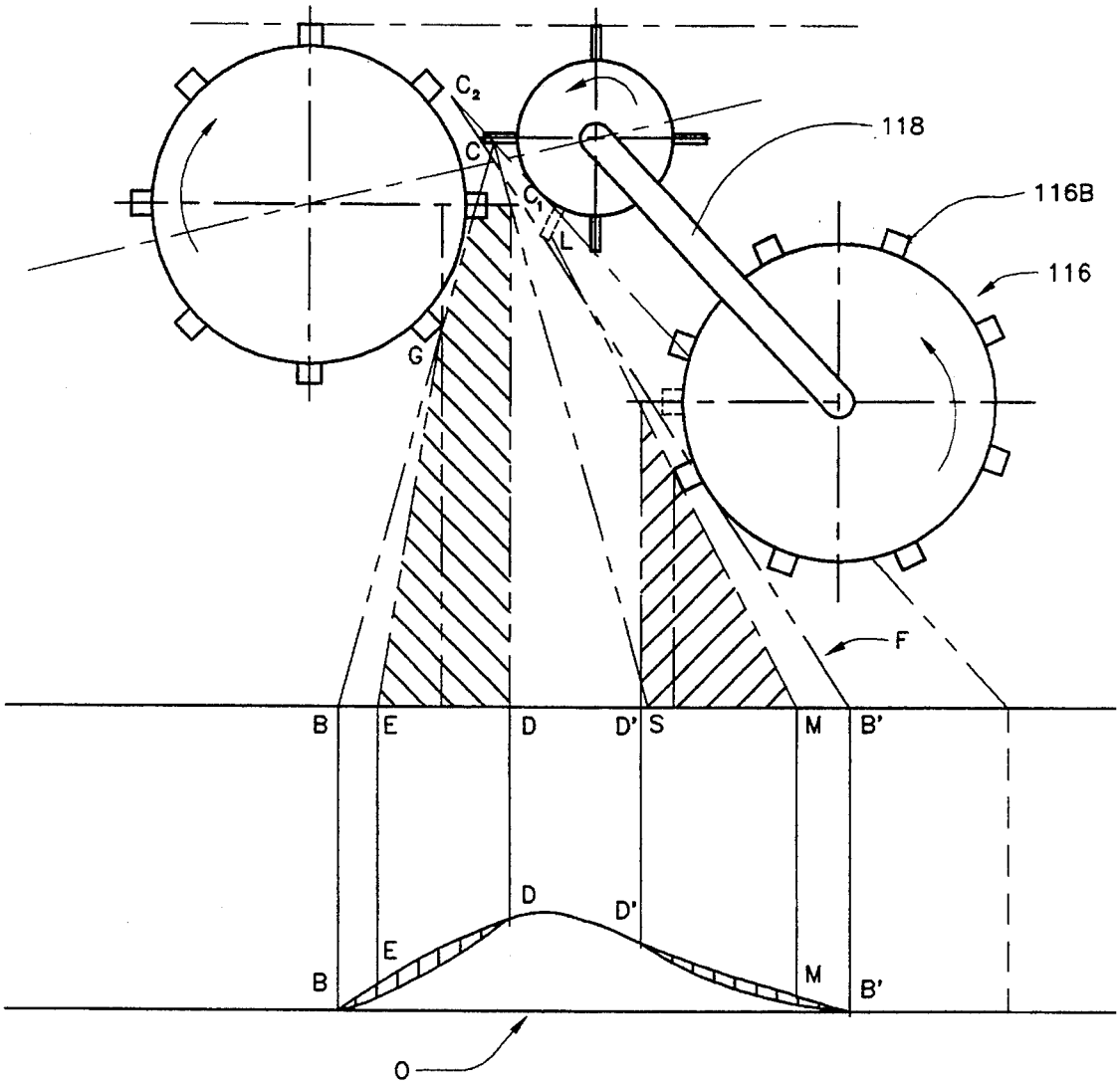
FIGS. 6 through 10 are schematic views of the dispensing unit of the apparatus of FIG. 4 illustrating various positions of a lower-level roller at different stages from the beginning to the end of the process.

FIG. 6 is the same as FIG. 5, but differs from it by the introduction of large-diameter low-level rotor 116 into flow F. This introduction changed the pattern of distribution of components of the concrete mixture. More specifically, those long fibers and particles of the coarse aggregate which have centers of gravity outside the edges of blades 116*b* are thrown onto the surface of object O between points D and B, while the mortar component particles, the center of gravity of which is normally below the height of blade 116*b*, are directed to the zone between points D'B'.

Figure 7:
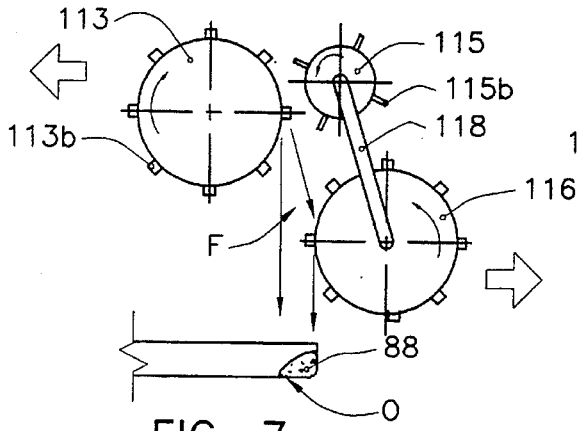

FIG. 7 shows mutual positions of rotors 113, 115, and 116 at the very beginning of the process of laying DRFC onto object O, where it is important to prevent recoiling of particles of the coarse aggregate and long fibers from the corner of object O. It is achieved by introducing rotor 116 deeper into flow F and thus reducing the angle of scattering.

Figure 8:
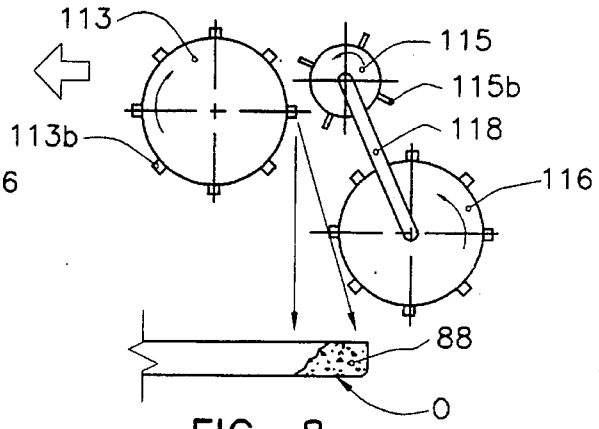
Figure 9:
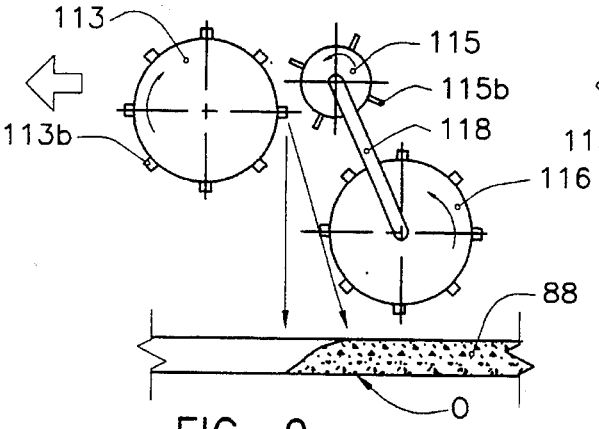
Figure 10:
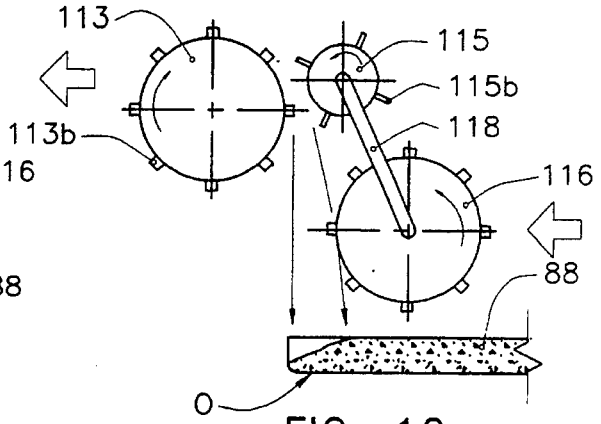

FIGS. 8, 9, and 10 shows positions of rotors with lower-level rotor 116 being partially or completely removed from flow F during the formation of an intermediate portion of object O.

Figure 11:
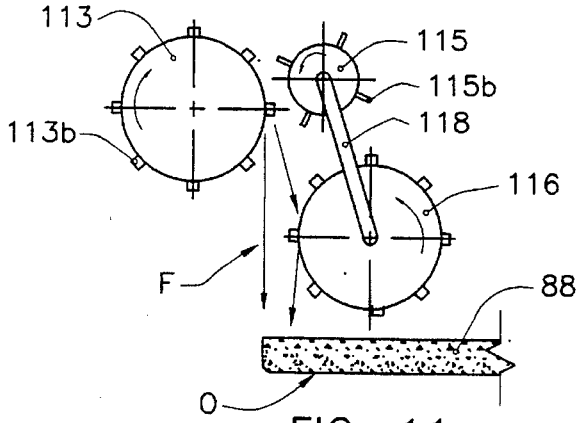
FIG. 11 is similar to FIG. 10 but shows the changes which occur when the lower-level rotor is introduced into the flow.

FIG. 11 show conditions similar to those of FIG. 7, but for the formation of the opposite end of object O. In other words, in order to make the surface of object O smooth at the corners, its upper layer is formed of a pure mortar component, as shown in FIG. 6 (a zone between points D' and B').

Thus, by turning arm 118 with lower-level rotor 116 around the center of rotation of rotor 115 and by changing the composition and quantities of the cement mixture components and speeds of rotation of rotors, it is possible to adjust the apparatus to any specific conditions and technical requirements of the formed product.

The method for the preparation, placement, and compacting consists of proving capacities arranged in a predetermined sequence, loading the aforementioned capacities with predetermined loose material components, unloading dosed quantities of the material components in a predetermined sequence onto a continuously moving conveyer thus forming a "sandwich" of the aforementioned material components movable with the aforementioned conveyor, unloading the sandwich in the form of a controllable flow onto a large-diameter upper-level rotor of a dispensing device capable of laying the flow onto an object with a predetermined angle of scattering of the material components of the flow and with reorientation of the material components and with controllable concentration and speed of movement of the material components in different sectors of the angle of scattering, the object and the dispensing device being moved with respect to each other.

The above "sandwich" consists of a layer of cement mortar, a layer of long fibers, and a layer of coarse aggregate. In addition to the aforementioned sandwich, the flow of material components in the dispenser periodically receives dosed portions of short fibers fed to a predetermined sector of rotor 113.

It is an essential feature of the method of the invention that the angle $\gamma$ formed by the direction of flow F with respect to the perpendicular to the surface of object O should not exceed 30°. This is because with angle $\gamma$ exceeding 30° the layer of the concrete matrix formed in the above process will have low density and will be subject, during the subsequent use, to the loss of strength.

Figure 12:
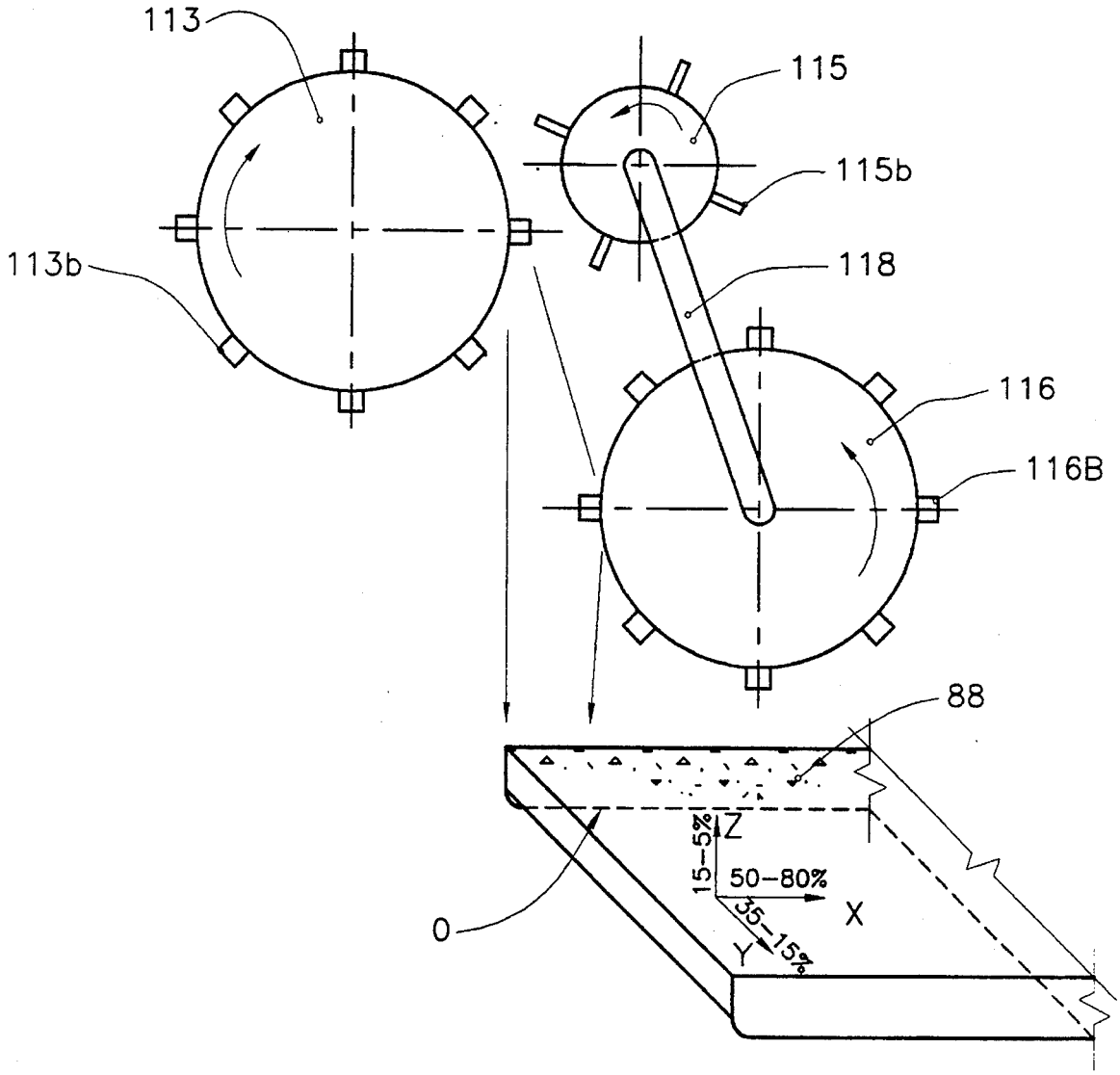
FIG. 12 is a three-dimensional view of a layer of discretely-reinforced fibrous concrete formed by the apparatus using method of the invention.

The DRFC layer obtained by laying the flow onto the object by means of the apparatus and method of the invention has the following contents by mass of the fiber components: 50 to 80% in the direction of laying the material components (axis X); 35 to 15% in the transverse direction perpendicular to the direction of axis X (axis Y); and 15 to 5% in the direction perpendicular to the X–Y plane (axis Z). The above axes are shown in FIG. 12 which is a three-dimensional view of a layer of DRFC produced by the apparatus and method of the invention.

Thus, it has been shown that we have provided an apparatus and method for the preparation, placement, and compacting of fibrous concrete and mixture of fibrous concrete with other components. The layer of the fibrous concrete obtained by using the apparatus and method possesses an increase resistance to cracking, high impact strength, and inreased ability to deform without collapse. The apparatus which we invented is capable to develop centrifugal forces sufficient to impart to the layer the above properties. The apparatus of the above type has a number of flow-controlling functions. Furthermore, the apparatus may favorably utilize the sequence of the supply of components into the feed flow in the space between rotors of the upper layer. We also invented a method for the preparation, placement, and compacting of fibrous concrete or its components which produces a dispersely-reinforced construction having an increased resistance to cracking, high impact strength, and ability to deform without collapse. The method allows to control orientation of fibers in DRFC with predetermined content by mass in the direction of three orthogonal axes.

Although the apparatus and method have been shown and described in the form of specific embodiments, these embodiments, their parts, materials, and configurations have been given only as examples, and that other modifications of the method and apparatus are possible. For example, apart from metallic, glass, synthetic, mineral or similar fibers, the fibers may be organic fibers. Although specific number of blades is shown in the drawings, this number may be different.

Although the layer of DRFC was shown laid onto an open surface, the flow of the material components can be laid into a form or into a confined space of a construction.

The apparatus was shown and described with four hoppers for handling four separate components of fibrous concrete. However, this should not be construed as limiting the invention, since the number of hoppers and respective components may exceed four.

Furthermore, the apparatus can be stationary or mobile and installed on a vehicle or on a portal crane.

Therefore, the scope of the invention should be determined, not by the examples given, but by the appended claims and their legal equivalents.

What we claim is:

1. An apparatus for the preparation, placement, and compacting of components of fibrous concrete laid onto an object comprising:

a rigid frame which can be installed above said object;

a plurality of capacities for receiving a plurality of fibrous concrete components, said capacities being arranged in a predetermined sequence, said capacities having means for unloading dosed quantities of said fibrous concrete components;

transportation means located under said capacities for receiving said dosed quantities, said transportation means having an unloading end and moving said plurality of fibrous concrete components in a predetermined direction;

an additional capacity for receiving an additional fibrous concrete component, said additional capacity having means for dosed unloading of said additional fibrous concrete component;

a dispensing means for laying and compacting a flow of said fibrous concrete components onto said object while said dispensing means and said object are moved with respect to each other, said dispensing means being located under said unloading end of said transportation means, said dispensing means having an upper level and a lower level and comprising:

a first body of rotation having an outer diameter;

a second body of rotation having an outer diameter;

a third body of rotation having an outer diameter;

said first body of rotation and said second body of rotation being located in said upper level, said third body of rotation being located in said lower level, said outer diameter of said first body of rotation being equal to said outer diameter of said third body of rotation, said outer diameters of said first body of rotation and said third body of rotation being greater than said outer diameter of said second body of rotation, said first body of rotation having means for catching, holding, transporting, and throwing said fibrous concrete components onto said object and partially onto said second body of rotation, said second body of rotation having means for catching, holding, transporting, and throwing said fibrous concrete components onto said object, said third body of rotation having means for catching, holding, transporting, and throwing a part of said fibrous concrete components onto said object, said additional capacity having means for dosed periodic supply of said additional fibrous concrete component onto said first body of rotation.

2. The apparatus of claim 1 wherein said third body of rotation having a first extreme position where said third body of rotation interferes with said flow, a second extreme position where said third body of rotation is beyond the limits of said flow, and means for moving and installing said third body of rotation between said first extreme position and second extreme position.

3. The apparatus of claim 2 wherein said plurality of capacities is four and comprises a first hopper, a second hopper, a third hopper, and a fourth hopper, said plurality of fibrous concrete components comprising short fibers contained in said first hopper, course aggregate contained in said second hopper, long fibers contained in said third hopper, and a cement mortar contained in said fourth hopper, said first hopper, said second hopper, said third hopper, and said fourth hopper being arranged sequentially in the direction opposite to said predetermined direction.

4. The apparatus of claim 3 wherein said means for catching, holding, transporting, and throwing of said fibrous concrete components located on said first body of rotation, second body of rotation, and third body of rotation, respectively, comprise first outwardly extending elements having an outer diameter and outer edges, second outwardly extending elements having an outer diameter and outer edges, and third outwardly extending elements having an outer diameter and outer edges, respectively, a ratio of said outer diameter of said second body of rotation to said outer diameter of said second outwardly extending elements being within the range of 0.4 to 0.7, a ratio of said outer diameter of said first body of rotation to said outer diameter of said first outwardly extending elements being within the range of 0.93 to 0.98, a ratio of said outer diameter of said first body of rotation to said outer diameter of said second body of rotation being of 1.04 to 1.82, a distance between said outer edges of said first outwardly extending elements and said outer edges of said second outwardly extending elements being within the range of 5 to 20 mm, said first body of rotation having a first center of rotation, said second body of rotation having a second center of rotation, a plane passing through said first and said second centers of rotation forming an angle of 5° to 25° to a horizontal plane.

5. The apparatus of claim 4 wherein said transporting means comprises a conveyor, said capacities comprise hoppers having outlet openings, said means for unloading dosed quantities of said fibrous concrete components comprise adjustable gates on said outlet openings of said metering devices for controlling the weight of said fibrous concrete components on said conveyor, said means for moving and installing said third body of rotation between said first extreme position and second extreme position comprising an arm pivotally installed with respect to said center of rotation of said second body of rotation.

6. A method for the preparation, placement, and compacting of fibrous concrete material components laid onto an object comprising the steps of:

proving an apparatus having a plurality of capacities arranged in a predetermined sequence, a transportation means, and a dispensing means for unloading said fibrous concrete material components onto said object, said dispensing means consisting of a first rotor, a second rotor, and a third rotor, said first rotor and said second rotor being installed in an upper level, said third rotor being installed in a lower level;

loading said capacities with predetermined loose material components;

unloading dosed quantities of said loose material components in a predetermined sequence onto said transportation means thus forming a sandwich of said loose material components moved by said transportation means;

unloading said sandwich onto said first rotor;

converting said sandwich into a diverging flow directed onto said object with a predetermined direction and with a predetermined angle of scattering of said loose material components of said flow, said angle of scattering having different sectors, said loose material components having predetermined density distributions in said sectors;

controlling speed of said loose material components and said density distributions in said different sectors of said angle of scattering during said conversion step; and reorienting said loose material components, said density distributions in said sectors, and controlling the direction of said loose material components within said angle of scattering;

directing said diverging flow onto said object; and moving said apparatus and said object with respect to each other.

7. The method of claim 6 which produces on said object a compacted layer of fibrous concrete material with following contents by mass of the fiber components: 50 to 80% in the first direction which is a direction of laying the material components; 35 to 15% in the second direction which is a transverse direction perpendicular to said first direction; and 15 to 5% in the direction perpendicular to a plane which contains said first direction and said second direction.

8. The method of claim 7 wherein said transportation means comprises a conveyor.

9. The method of claim 6 wherein said step of controlling the speed and said density distributions of said loose material components is carried out by periodically directing a dozed amount of short fibers onto said first rotor for introduction of said short fibers into a predetermined sector of said angle of scattering and by introducing said third rotor into said diverging flow.

10. The method of claim 6 wherein said step of controlling the speed and said density distributions of said loose material components is carried out by changing speeds of rotation of said first rotor, said second rotor, and said third rotor.

11. The method of claim 6 wherein said direction forms with a perpendicular to the surface of said object O an angle within the range of 0° to 30°.

12. An apparatus for the preparation, placement, and compacting of components of fibrous concrete laid onto an object comprising:

a rigid frame which can be installed above said object;

a plurality of capacities for receiving a plurality of fibrous concrete components, said capacities being arranged in a predetermined sequence, said capacities having means for unloading dosed quantities of said fibrous concrete components;

transportation means located under said capacities for receiving said dosed quantities, said transportation means having an unloading end and moving said plurality of fibrous concrete components in a predetermined direction;

an additional capacity for receiving an additional fibrous concrete component, said additional capacity having means for dosed unloading of said additional fibrous concrete component;

a dispensing means for laying and compacting a flow of said fibrous concrete components onto said object while said dispensing means and said object are moved with respect to each other, said dispensing means being located under said unloading end of said transportation means, said dispensing means having an upper level and a lower level comprising:

a first body of rotation having an outer diameter;

a second body of rotation having an outer diameter;

a third body of rotation having an outer diameter, said first body of rotation and said second body of rotation being located in said upper level, said third body of rotation being located in said lower level, said outer diameter of said first body of rotation being equal to said outer diameter of said third body of rotation, said outer diameters of said first body of rotation and said third body of rotation being greater than said outer diameter of said second body of rotation, said first body of rotation having means for catching, holding, transporting, and throwing said fibrous concrete components onto said object and partially onto said second body of rotation, said second body of rotation having means for catching, holding, transporting, and throwing said fibrous concrete components onto said object, said third body of rotation having means for catching, holding, transporting, and throwing a part of said fibrous concrete components onto said object, said additional capacity having means for dosed periodic supply of said additional fibrous concrete component onto said first body of rotation, said third body of rotation having a first extreme position where said third body of rotation interferes with said flow, a second extreme position where said third body of rotation is beyond the limits of said flow, and means for moving and installing said third body of rotation between said first extreme position and second extreme position, said plurality of capacities is four and comprises a first hopper, a second hopper, a third hopper, and a fourth hopper, said plurality of fibrous concrete components comprising short fibers contained in said first hopper, course aggregate contained in said second hopper, long fibers contained in said third hopper, and a cement mortar contained in said fourth hopper, said first hopper, said second hopper, said third hopper, and said fourth hopper being arranged sequentially in the direction opposite to said predetermined direction.

13. The apparatus of claim 12 wherein said means for catching, holding, transporting, and throwing of said fibrous concrete components located on said first body of rotation, second body of rotation, and third body of rotation, respectively, comprise first outwardly extending elements having an outer diameter and outer edges, second outwardly extending elements having an outer diameter and outer edges, and third outwardly extending elements having an outer diameter and outer edges, respectively, a ratio of said outer diameter of said second body of rotation to said outer diameter of said second outwardly extending elements being within the range of 0.4 to 0.7, a ratio of said outer diameter of said first body of rotation to said outer diameter of said first outwardly extending elements being within the range of 0.93 to 0.98, a ratio of said outer diameter of said first body of rotation to said outer diameter of said second body of rotation being of 1.04 to 1.82, a distance between said outer edges of said first outwardly extending elements and said outer edges of said second outwardly extending elements being within the range of 5 to 20 mm, said first body of rotation having a first center of rotation, said second body of rotation having a second center of rotation, a plane passing through said first and said second centers of rotation forming an angle of 5° to 25° to a horizontal plane, said transporting means comprises a conveyor, said capacitances comprise hoppers having outlet openings, said means for unloading dosed quantities of said fibrous concrete components comprise adjustable gates on said outlet openings of said metering devices for controlling the weight of said fibrous concrete components on said conveyor, said means for moving and installing said third body of rotation between said first extreme position and second extreme position comprising an arm pivotally installed with respect to said center of rotation of said second body of rotation.

14. A method for the preparation, placement, and compacting of fibrous concrete material components laid onto an object comprising the steps of:

proving an apparatus having a plurality of capacities arranged in a predetermined sequence, a transportation means, and a dispensing means for unloading said fibrous concrete material components onto said object, said dispensing means consisting of a first rotor, a second rotor, and a third rotor, said first rotor and said second rotor being installed in an upper level, said third rotor being installed in a lower level;

loading said capacities with predetermined loose material components;

unloading dosed quantities of said loose material components in a predetermined sequence onto said transportation means thus forming a sandwich of said loose material components moved by said transportation means;

unloading said sandwich onto said first rotor;

converting said sandwich into a diverging flow directed onto said object with a predetermined direction and with a predetermined angle of scattering of said loose material components of said flow, said angle of scattering having different sectors, said loose material components having predetermined density distributions in said sectors;

controlling speed of said loose material components and said density distributions in said different sectors of said angle of scattering during said conversion step; and reorienting said loose material components, said density distributions in said secors and changing the movement of said loose material components within said angle of scattering;

directing said diverging flow onto said object;

moving said apparatus and said object with respect to each other; said method producing on said object a compacted layer of fibrous concrete material with following contents by mass of the fiber components: 50 to 80% in the first direction which is a direction of laying the material components; 35 to 15% in the second direction which is a transverse direction perpendicular to said first direction; and 15 to 5% in the direction perpendicular to a plane which contains said first direction and said second direction, said transportation means comprising a conveyor.

15. The method of claim 14 wherein said step of controlling the speed and said density distributions of said loose material components is carried out by periodically directing a dozed amount of short fibers onto said first rotor for introduction of said short fibers into a predetermined sector of said angle of scattering and by introducing said third rotor into said diverging flow.

16. The method of claim 6 wherein said step of controlling the speed and said density distributions of said loose material components is carried out by changing speeds of rotation of said first rotor, said second rotor, and said third rotor, said direction forming with a perpendicular to the surface of said object O an angle within the range of 0° to 30°.

* * * * *